US009759473B2

(12) United States Patent
Kim et al.

(10) Patent No.: US 9,759,473 B2
(45) Date of Patent: Sep. 12, 2017

(54) REFRIGERATOR AND METHOD FOR CONTROLLING THE SAME

(75) Inventors: Yong Han Kim, Cheonan-si (KR); Kook Jeong Seo, Suwon-si (KR); Bong Su Son, Cheonan-si (KR); Jeong Min Jeon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 300 days.

(21) Appl. No.: 13/592,800

(22) Filed: Aug. 23, 2012

(65) Prior Publication Data

US 2013/0047659 A1 Feb. 28, 2013

(30) Foreign Application Priority Data

Aug. 31, 2011 (KR) ..... 10-2011-0087506

(51) Int. Cl.
*F25D 11/02* (2006.01)
*F25B 6/00* (2006.01)
*F25B 5/00* (2006.01)

(52) U.S. Cl.
CPC ..... *F25D 11/022* (2013.01); *F25B 2400/06* (2013.01); *F25B 2400/12* (2013.01); *F25D 2400/14* (2013.01); *F25D 2700/121* (2013.01)

(58) Field of Classification Search
CPC ..... F25D 11/022; F25D 2700/121; F25D 23/069; F15D 2400/14; F25B 1/00
USPC ..... 62/204, 441, 442, 115, 203, 419
See application file for complete search history.

(56) References Cited

U.S. PATENT DOCUMENTS 2,443,342 A * 6/1948 Colvin ..... A47F 3/043 52/171.3
2,755,634 A * 7/1956 Simmons ..... F25D 11/02 62/152
5,062,985 A * 11/1991 Takemasa ..... C09K 5/044 252/67

(Continued)

FOREIGN PATENT DOCUMENTS

CN 101326410 12/2008
CN 101684979 3/2010

(Continued)

OTHER PUBLICATIONS

Korean Notice of Allowance dated Dec. 23, 2014 in Korean Patent Application No. 10-2011-0087506.

(Continued)

*Primary Examiner* — Jianying Atkisson
*Assistant Examiner* — Kun Kai Ma
(74) *Attorney, Agent, or Firm* — Staas & Halsey LLP

(57) ABSTRACT

A refrigerator includes a first storage chamber, a second storage chamber spatially-separated from the first storage chamber, a first refrigeration cycle system to cool the first storage chamber using a first refrigeration cycle, and a second refrigeration cycle system installed to be separated from the first refrigeration cycle system to cool the second storage chamber using a second refrigeration cycle in an independent manner from the first refrigeration cycle. The first and second storage chambers maintain first and second target temperatures, respectively. The first and second refrigeration cycle systems circulate different kinds of refrigerants to cool the first and second storage chambers, respectively.

18 Claims, 8 Drawing Sheets

(56) References Cited

U.S. PATENT DOCUMENTS

| | | | | |
|---|---|---|---|---|
| 5,624,595 | A * | 4/1997 | Sato et al. | 252/68 |
| 7,975,497 | B2 | 7/2011 | Kaga et al. | |
| 8,555,663 | B2 * | 10/2013 | Shinya | F25B 49/027 62/175 |
| 2002/0134096 | A1 * | 9/2002 | Shim et al. | 62/228.1 |
| 2005/0022547 | A1 * | 2/2005 | Lee | A47B 73/008 62/258 |
| 2009/0000329 | A1 * | 1/2009 | Colberg et al. | 62/335 |
| 2009/0001866 | A1 * | 1/2009 | Kaga et al. | 312/401 |
| 2009/0084120 | A1 * | 4/2009 | Meier | B64F 1/362 62/129 |
| 2010/0107659 | A1 * | 5/2010 | Hildreth, Jr. | F25B 5/02 62/77 |
| 2010/0154406 | A1 * | 6/2010 | Conard et al. | 60/531 |
| 2011/0030402 | A1 * | 2/2011 | Shinya | F25B 49/027 62/186 |
| 2011/0126038 | A1 * | 5/2011 | Korba et al. | 713/401 |
| 2011/0256005 | A1 * | 10/2011 | Takeoka et al. | 417/415 |
| 2013/0019629 | A1 * | 1/2013 | Kim | F25D 23/003 62/408 |
| 2014/0007610 | A1 * | 1/2014 | Jeon | F25D 11/02 62/419 |

FOREIGN PATENT DOCUMENTS

| | | | |
|---|---|---|---|
| CN | 101749909 | | 6/2010 |
| JP | 7-71857 | | 3/1995 |
| JP | 10288427 | A * | 10/1998 |
| JP | 2000-220943 | | 8/2000 |
| JP | 2010-60146 | | 3/2010 |
| KR | 10-2010-0041076 | | 4/2010 |
| WO | 2010/082472 | A1 | 7/2010 |
| WO | WO 2011112495 | A2 * | 9/2011 |

OTHER PUBLICATIONS

Korean Office Action issued Jul. 21, 2014 in Korean Patent Application No. 10-2011-0087506.

Chinese Office Action dated Sep. 2, 2015 in corresponding Chinese Patent Application No. 201210320684.4.

Chinese Office Action dated Sep. 21, 2016 in corresponding Chinese Patent Application No. 201210320684.4.

Fourth Chinese Office Action issued Mar. 16, 2017 in related Chinese Patent Application No. 201210320684.4 (9 pages) (16 pages English Translation).

* cited by examiner

FIG. 5

| PROPERTIES | REFRIGERANT | | | REMARKS |
|---|---|---|---|---|
| | R600 | R600a | R134a | |
| PRESSURE (kPa) | 28 | 46 | 84 | Based on -30℃ of saturation temperature and 25℃ of refrigerant temperature |
| DENSITY (kg/m$^3$) | 0.67 | 1.11 | 3.54 | |
| REFRIGERATION EFFECT (kj/kg) | 410 | 383 | 219 | |
| REFRIGERATION CAPACITY PER UNIT VOLUME (kj/m$^3$) | 274 | 424 | 776 | R600a□H□H□ 65%<br>R134a□H□H□ 35% |

REFRIGERATOR AND METHOD FOR CONTROLLING THE SAME

CROSS-REFERENCE TO RELATED APPLICATIONS

This application claims the priority benefit of Korean Patent Application No. 10-2011-0087506, filed on Aug. 31, 2011 in the Korean Intellectual Property Office, the disclosure of which is incorporated herein by reference.

BACKGROUND

1. Field

The following description relates to a refrigerator to efficiently cool a plurality of storage chambers and a method of controlling the same.

2. Description of the Related Art

A refrigerator is an apparatus to keep stored objects such as food and beverages fresh for a long time.

The refrigerator has a plurality of storage chambers including a freezing chamber to keep stored objects in a frozen state and a refrigerating chamber to keep stored objects in a refrigerated state. The refrigerator maintains chamber temperatures in the freezing and refrigerating chambers at respective set target temperatures by repeatedly performing a refrigeration cycle consisting of compression, condensation, expansion, and evaporation of a refrigerant.

Such a refrigerator is equipped with a compressor, condenser, expansion valve (or a capillary tube), and evaporator, for example, to perform the refrigeration cycle consisting of compression, condensation, expansion, and evaporation.

To be specific, the refrigerator maintains chamber temperatures in the freezing and refrigerating chambers at respective target temperatures by driving, based on the respective set target temperatures of the freezing and refrigerating chambers, at least one fan installed in each of the freezing and refrigerating chambers so that heat exchanged air at an evaporator is blown into the storage chambers associated with each fan.

However, since such a refrigerator must maintain the chamber temperatures in the freezing and refrigerating chambers at the respective target temperatures using a single evaporator, the refrigerator may not provide a suitable cooling environment as desired by a user.

For this reason, a refrigerator has recently been developed wherein each of the freezing and refrigerating chambers is provided with an evaporator and expansion valve. This refrigerator maintains chamber temperatures in the freezing and refrigerating chambers at a freezing temperature and refrigerating temperature, respectively, by adjusting an amount of refrigerant supplied from the compressor into the respective evaporators via control of the respective expansion valves.

Moreover, in consideration of a great difference between the chamber target temperatures in the freezing and refrigerating chambers, a refrigerator has recently been developed which has freezing and refrigerating compressors having different refrigeration capacities. Such a refrigerator maintains the chamber temperatures in the freezing and refrigerating chambers at respective target temperatures by controlling operations of the associated compressors based on the respective target temperatures in the freezing and refrigerating chambers.

This type of refrigerating compressor has a refrigeration capacity as small as approximately 6/10 of that of an existing compressor, in order to increase an evaporation temperature in the refrigeration cycle to cool the refrigerating chamber.

In other words, the refrigerator further includes a small compressor with a smaller refrigeration capacity in order to increase the evaporation temperature in the refrigeration cycle to cool the refrigerating chamber.

Because a smaller compressor has a suction valve with a lower suction rate of refrigerant due to its smaller size, and operation of the valve is also inefficient compared to a large compressor, mechanical and volumetric efficiencies thereof are lower than those of a large compressor with a large cylinder.

That is, the smaller the compressor size, the smaller the stroke volume, and thus the larger the mechanical loss and volume loss. Therefore, as the stroke volume is reduced, compressor efficiency is greatly lowered, thereby causing a reduction in the effectiveness of the refrigeration cycle.

SUMMARY

Therefore, it is one aspect to provide a refrigerator including mechanically-separated first and second refrigeration cycle systems to cool first and second storage chambers, respectively, by independently performing first and second refrigeration cycles thereof, and to provide a method to control the same.

It is another aspect to provide a refrigerator in which there are first and second storage chambers and corresponding first and second refrigeration cycle systems, and a refrigerant having a smaller refrigeration capacity per unit volume is used as a refrigerant of a refrigeration cycle system corresponding to one storage chamber having a higher target temperature than that of the other, and to provide a method to control the same.

It is another aspect to provide a refrigerator wherein a plurality of storage chambers, in which different kinds of refrigerants are contained, are cooled using a plurality of refrigeration cycles, respectively, and the refrigerant, which has a smaller refrigeration capacity per unit volume than the remaining refrigerants, is contained in the refrigeration cycle system corresponding to the storage chamber which has a higher target temperature than the remaining storage chambers.

Additional aspects will be set forth in part in the description which follows and, in part, will be obvious from the description, or may be learned by practice of the invention.

In accordance with one aspect , a refrigerator may include a first storage chamber, a second storage chamber spatially-separated from the first storage chamber, a first refrigeration cycle system which includes a first compressor to compress a first refrigerant and circulates the first refrigerant from the first compressor to cool the first storage chamber, and a second refrigeration cycle system which includes a second compressor to compress a second refrigerant and circulates the second refrigerant from the second compressor to cool the second storage chamber.

The first and second refrigeration cycle systems may be installed to be separated from each other and circulate different refrigerants using different refrigeration cycles.

The first storage chamber may maintain a first target temperature. The second storage chamber may maintain a second target temperature higher than the first target temperature. The refrigerant of the second refrigeration cycle system may have a smaller refrigeration capacity per unit volume than that of the refrigerant of the first refrigeration cycle system.

The refrigerator may further include a first temperature detection unit to detect a chamber temperature of the first storage chamber, a second temperature detection unit to detect a chamber temperature of the second storage chamber, and a control unit to respectively control operations of the first and second refrigeration cycle systems based on the chamber temperatures of the first and second storage chambers and the first and second target temperatures.

The first and second storage chambers may be freezing and refrigerating chambers respectively.

The first refrigeration cycle system may further include a first condenser to emit heat from the compressed first refrigerant from the first compressor, a first expansion valve to reduce a pressure of the heat-emitted first refrigerant, and a first evaporator to absorb heat using the pressure-reduced first refrigerant and to transfer the first refrigerant having absorbed heat to the first compressor.

The second refrigeration cycle system may further include a second condenser to emit heat from the compressed second refrigerant from the second compressor, a second expansion valve to reduce a pressure of the heat-emitted second refrigerant, and a second evaporator to absorb heat using the pressure-reduced second refrigerant and transfer the second refrigerant with the absorbed heat to the second compressor.

In accordance with another aspect, a refrigerator may include a first storage chamber maintained at a first target temperature, a second storage chamber maintained at a second target temperature higher than the first target temperature, a first refrigeration cycle system to circulate a first refrigerant to cool the first storage chamber, and a second refrigeration cycle system to circulate a second refrigerant to cool the second storage chamber.

The first refrigeration cycle system may include a first compressor, condenser, expansion valve, and evaporator to circulate the first refrigerant. The second refrigeration cycle system may include a second compressor, condenser, expansion valve, and evaporator to circulate the second refrigerant.

The refrigerator may further include a first blowing fan to blow air having undergone heat exchange at the first evaporator to the first storage chamber, and a second blowing fan to blow air having undergone heat exchange at the second evaporator to the second storage chamber.

The refrigerator may further include at least one heat-discharge fan to cool the first and second condensers.

The refrigerator may further include a first temperature detection unit to detect a chamber temperature of the first storage chamber, a second temperature detection unit to detect a chamber temperature of the second storage chamber, and a control unit to control operations of the first and second compressors, operations of the first and second expansion valves, operations of the first and second blowing fans and an operation of the at least one heat-discharge fan, based on the chamber temperatures of the first and second storage chambers and the first and second target temperatures.

The second refrigerant may have a smaller refrigeration capacity per unit volume than that of the first refrigerant.

In accordance with still another aspect, a refrigerator may include a plurality of storage chambers, each chamber being maintained at different target temperatures, and a plurality of refrigeration cycle systems provided in a corresponding manner to a plurality of the storage chambers so as to cool the corresponding storage chambers. Different kinds of refrigerants may be contained in a plurality of the refrigeration cycle systems respectively. The higher the target temperatures of the corresponding storage chambers, the smaller the refrigeration capacities per unit volume of the refrigerants contained in the corresponding refrigeration cycle systems.

The plural refrigeration cycle systems may be installed to be separated from one another and individually carry out refrigeration cycles thereof.

In accordance with another aspect, provided is a method to control a refrigerator having separate first and second storage chambers. The method may include detecting a chamber temperature of the first storage chamber, controlling circulation of a first refrigerant in a first refrigeration cycle system based on the detected chamber temperature and a first target temperature of the first storage chamber so that a chamber temperature of the first storage chamber is kept at the first target temperature, detecting a chamber temperature of the second storage chamber, and controlling circulation of a second refrigerant in a second refrigeration cycle system based on the detected chamber temperature and a second target temperature of the second storage chamber so that a chamber temperature of the second storage chamber is kept at the second target temperature.

The controlling of the circulation of the first refrigerant and the controlling of the circulation of the second refrigerant may be independently performed.

The controlling of the circulation of the second refrigerant may include controlling circulation of a refrigerant having a smaller refrigeration capacity per unit volume than that of the first refrigerant.

The controlling of the circulation of the first refrigerant in the first refrigeration cycle system may include controlling an operation of a first compressor provided in the first refrigeration cycle system. The controlling of the circulation of the second refrigerant in the second refrigeration cycle system may include controlling an operation of a second compressor provided in the second refrigeration cycle system.

The method may further include, when both of the chamber temperatures of the first and second storage chambers exceed the first and second target temperatures respectively, controlling the first and second refrigeration cycle systems to operate simultaneously.

In accordance with one aspect, by mechanically separating the refrigeration cycle systems to cool first and second chambers respectively, that is, the freezing and refrigerating chambers and individually performing the refrigeration cycles for the freezing and refrigerating chambers, the respective refrigeration cycles may be optimally controlled and energy efficiency may be improved.

Further, employing the refrigerant having a smaller refrigeration capacity per unit volume as the refrigerant of the refrigeration cycle system corresponding to the refrigerating chamber, the stroke volume of the compressor for the refrigerating chamber may be increased, thereby preventing efficiency deterioration of the compressor.

BRIEF DESCRIPTION OF THE DRAWINGS

These and/or other aspects will become apparent and more readily appreciated from the following description of the embodiments, taken in conjunction with the accompanying drawings of which:

FIG. 5 is a table of a comparison example between properties of refrigerants contained in a refrigerator according to one embodiment;

DETAILED DESCRIPTION

Figure 1:
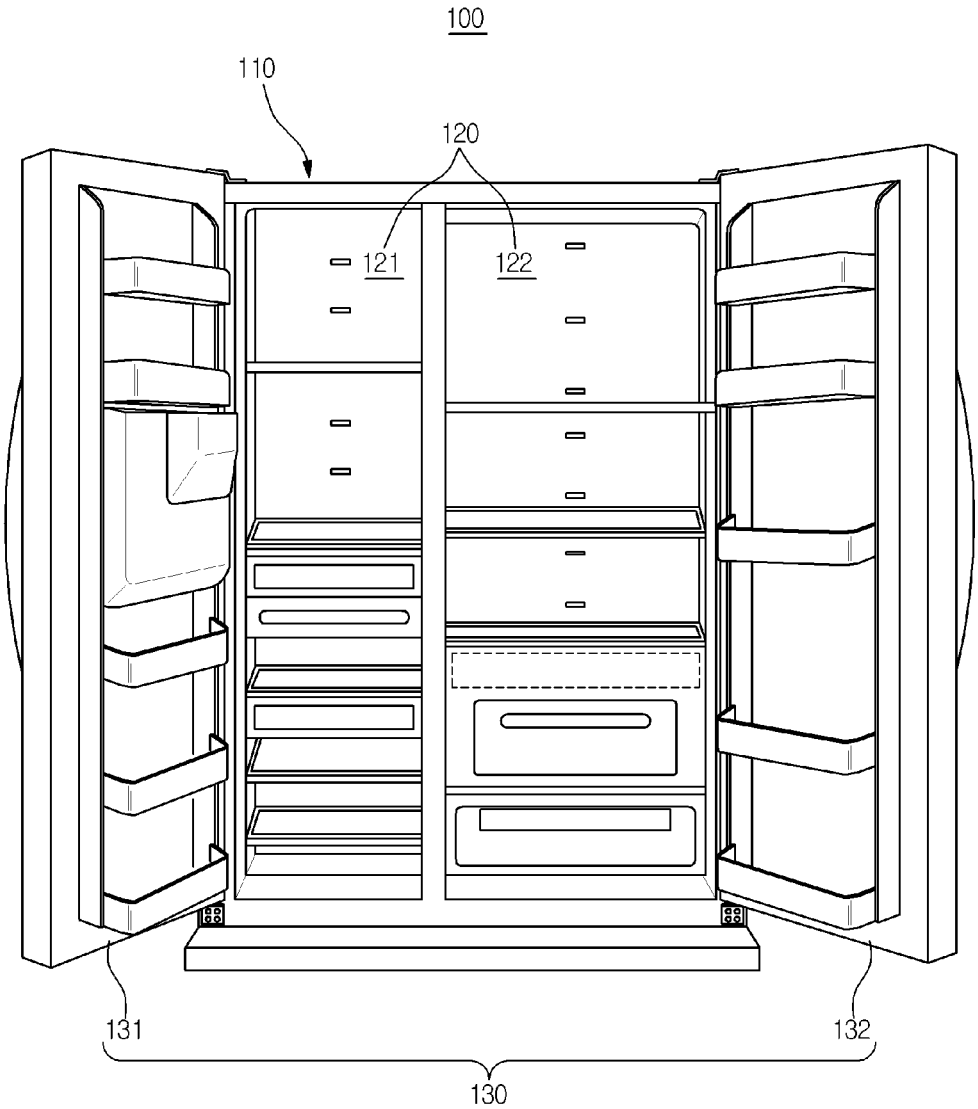
FIG. 1 is a perspective view illustrating a front of a refrigerator according to one embodiment.

Reference will now be made in detail to the embodiments, examples of which are illustrated in the accompanying drawings, wherein like reference numerals refer to like elements throughout.

Below, embodiments will be described in detail with reference to the accompanying drawings.

Figure 2:
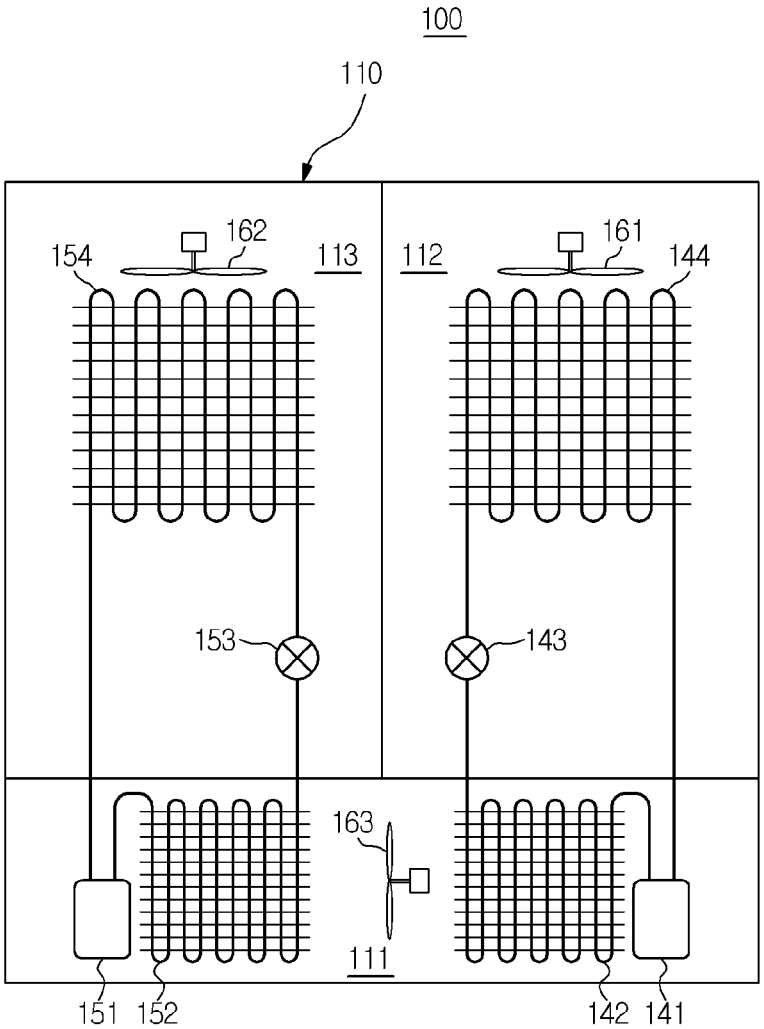
FIG. 2 is a view illustrating a rear of the refrigerator according to the illustrated embodiment.
Figure 3:
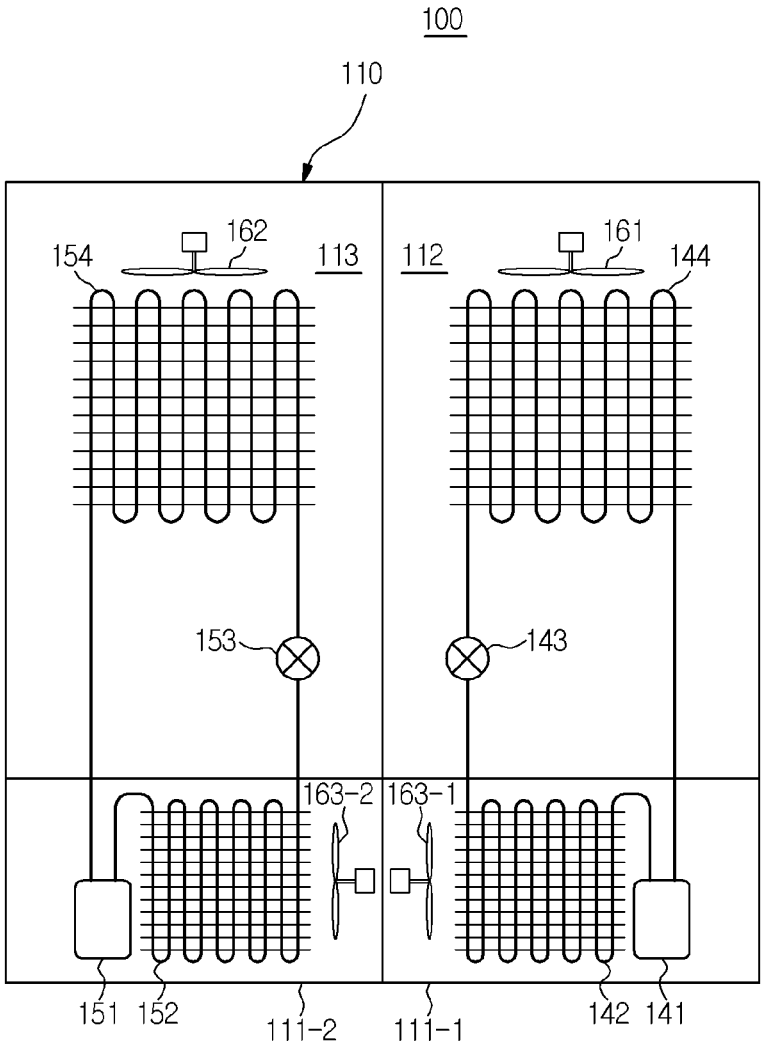
FIG. 3 is a view illustrating a rear of a refrigerator according to another embodiment.

FIG. 1 is a perspective view illustrating a front of a refrigerator according to one embodiment of the invention. FIG. 2 is a view illustrating a rear of the refrigerator according to the illustrated embodiment of the invention. FIG. 3 is a view illustrating a rear of a refrigerator according to another embodiment of the invention.

As shown in FIG. 1 and FIG. 2, a refrigerator 100 includes a body 110, storage chambers 120 (121,122), doors 130 (131,132), a first refrigeration cycle system 140, a second refrigeration cycle system 150, and a plurality of fans 161, 162, and 163.

The refrigerator 100 further includes a temperature detection unit 170.

The temperature detection unit 170 includes a first temperature detection unit 171 provided in a freezing chamber 121 to detect a chamber temperature of the freezing chamber 121 and a second temperature detection unit 172 provided in a refrigerating chamber 122 to detect a chamber temperature of the refrigerating chamber 122.

As shown in FIG. 2, the body 110 forms the appearance of the refrigerator 100. In an inner space of the body 110, a machinery chamber 111 and first and second cooling chambers 112 and 113 are formed.

The machinery chamber 111 and first and second cooling chambers 112 and 113 are separated from one another. The machinery chamber 111 is open to outside air whereas the first and second cooling chambers 112 and 113 are sealed from the outside to prevent cool air from leaking out of the chambers 112 and 113.

In a combination of spaces of the machinery chamber 111 and first cooling chamber 112, a first refrigeration cycle system 140 is formed. In a combination of spaces of the machinery chamber 111 and second cooling chamber 113, a second refrigeration cycle system 150 is formed.

More specifically, in the machinery chamber 111, there is provided a first compressor 141 to compress a first refrigerant, a first condenser 142 to condense the compressed first refrigerant via heat dissipation, a second compressor 151 to compress a second refrigerant and a second condenser 152 to condense the compressed second refrigerant via heat dissipation.

In the cooling chamber 112, there is provided a first expansion valve 143 to receive the condensed first refrigerant r1 through a first refrigerant pipe p1 in order to reduce the pressure of the condensed first refrigerant, and a first evaporator 144 to evaporate the pressure-reduced first refrigerant from the first expansion valve 143.

In the cooling chamber 113, there is provided a second expansion valve 153 to receive the condensed second refrigerant r2 through a second refrigerant pipe p2 in order to reduce the pressure of the condensed second refrigerant, and a second evaporator 154 to evaporate the pressure-reduced second refrigerant from the second expansion valve 153.

Although the machinery chamber 111 and first cooling chamber 112 are spatially separated from each other, they share the first refrigeration cycle system 140, which has an integrated structure, through the first refrigerant pipe p1. Similarly, although the machinery chamber 111 and second cooling chamber 113 are spatially separated from each other, they share the second refrigeration cycle system 150, which has an integrated structure, through the second refrigerant pipe p2.

In this way, the refrigerator 100 includes the mechanically-separated first and second refrigeration cycle systems 140 and 150. The first and second evaporators 144 and 154 included in the first and second refrigeration cycle systems 140 and 150, respectively, are spatially separated from each other.

In the first and second cooling chambers 112 and 113, there are respectively provided first and second blowing fans 161 and 162. Also, in the machinery chamber 111, there is provided a heat discharge fan 163.

As shown in FIG. 3, the machinery chamber 111 provided at the body 110 of the refrigerator 100 may be partitioned into two independent spaces, that is, first and second machinery chambers 111-1 and 111-2.

In this example of the refrigerator, the machinery chamber is divided into the two spatially-separated spaces so that the first compressor 141 and condenser 142 of the first refrigeration cycle system 140 and the second compressor 151 and condenser 152 of the second refrigeration cycle system 150 are installed in the two spatially-separated spaces, respectively. In this manner, when one of the first and second refrigeration cycle systems is operating, heat generated from the condenser of the refrigeration cycle system in the operating state may be substantially isolated from the compressor and condenser of the other refrigeration cycle system in a non-operating state.

Thus, in the first machinery chamber 111-1, there is provided the first compressor and condenser 141 and 142 of the first refrigeration cycle system 140, while in the second machinery chamber 111-2, there is provided the second compressor and condenser 151 and 152 of the second refrigeration cycle system 150.

Furthermore, in the first and second machinery chambers 111-1 and 111-2, there are respectively provided first and second heat discharge fans 163-1 and 163-2. Thus, the first and second heat discharge fans 163-1 and 163-2 may respectively cool the first and second condensers 141 and 151 installed in the first and second machinery chambers 111-1 and 111-2, respectively.

The refrigerator 100 includes an accommodation space formed by the body 110. At a horizontal middle position of the accommodation space, a partition wall is vertically formed. That is, the accommodation space of the refrigerator may be partitioned into left and right spaces.

The left and right spaces of the accommodation space of the refrigerator may form storage chambers 120 to keep stored objects therein. For example, the storage chambers 120 may include as a first storage chamber a freezing chamber 121 to keep stored objects in a frozen state and as a second storage chamber a refrigerating chamber 122 to keep stored objects in a refrigerated state.

Within the freezing chamber 121 and refrigerating chamber 122, racks and storage boxes to keep food are mounted.

A plurality of holes is formed through a side wall of the body 110 defining the freezing chamber 121. Similarly, a plurality of holes is formed through a side wall of the body 110 defining the refrigerating chamber 122.

Thus, through the plural holes formed through the side wall of the freezing chamber 121, air in the freezing chamber 121 and freezing air generated from the first cooling chamber 112 may circulate. Similarly, through the plurality of holes formed through the side wall of the refrigerating chamber 122, air in the refrigerating chamber 122 and refrigerating air generated from the second cooling chamber 113 may circulate.

The front side of the freezing and refrigerating chambers 121 and 122 are open. At the opened front sides of the freezing and refrigerating chambers 121 and 122, doors 130 (131, 132) are respectively formed. The doors 130 (131,132) shield the freezing and refrigerating chambers 121 and 122 from the outside thereof.

On inner wall surfaces of the doors 131 and 132, a plurality of door racks to keep food is mounted.

The refrigerator 100 includes the first and second refrigeration cycle systems 140 and 150 to cool the freezing and refrigerating chambers 121 and 122, respectively. In other words, the refrigerator 100 has a dual loop cycle in which, when there is a difference between the target temperatures of the freezing and refrigerating chambers, refrigeration cycles for the freezing and refrigerating chambers operate independently, thereby improving energy efficiency.

The first refrigeration cycle system 140 is provided at a rear portion of the body 110 corresponding manner to the freezing chamber 121 to cool the freezing chamber 121 by performing a first refrigeration cycle. The second refrigeration cycle system 150 is provided at a rear portion of the body 110 corresponding to the refrigerating chamber 122 to cool the refrigerating chamber 122 by performing a second refrigeration cycle. This will be described in detail with reference to FIG. 4.

Figure 4:
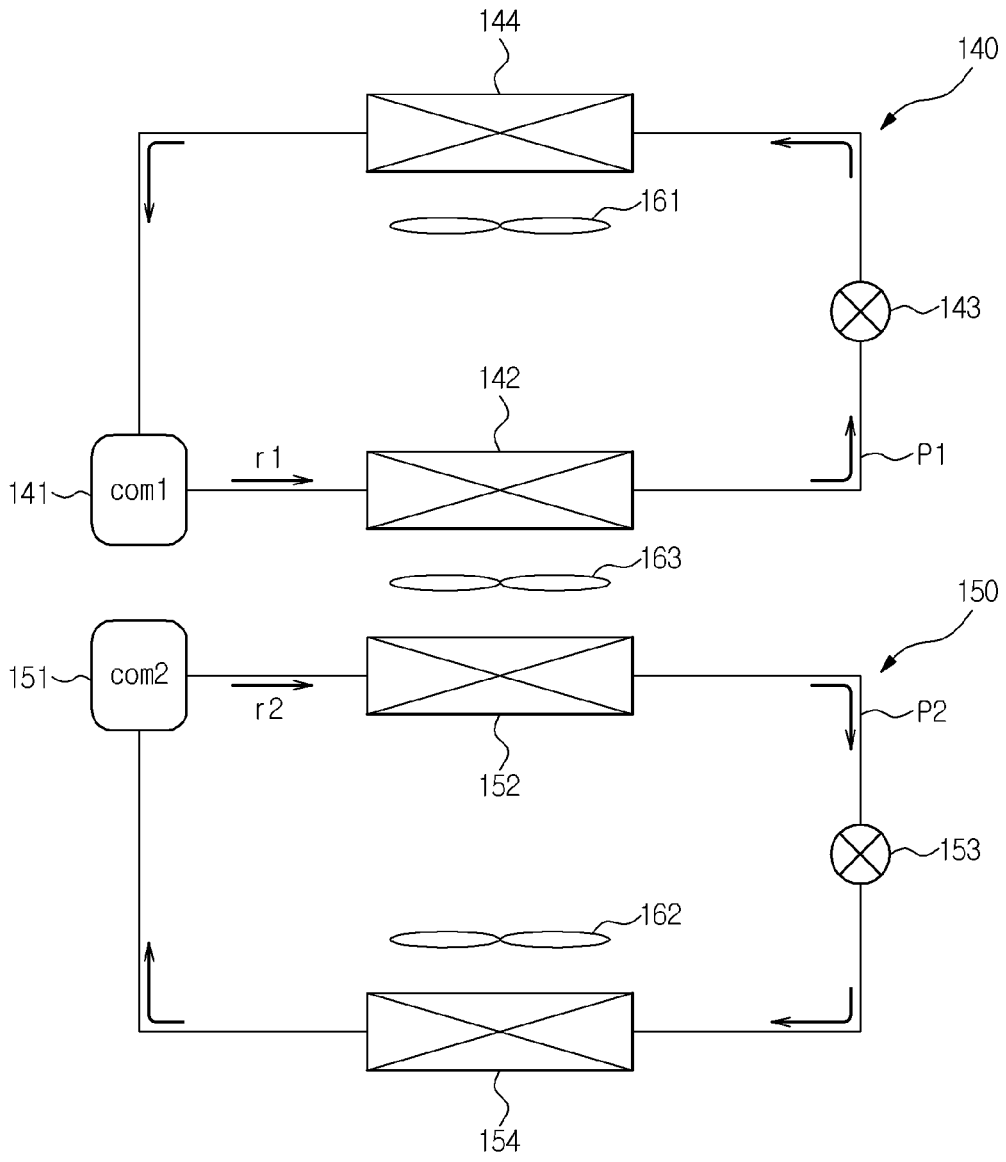
FIG. 4 illustrates a configuration of first and second refrigeration cycle systems of a refrigerator according to one embodiment.

As shown in FIG. 4, the first refrigeration cycle system 140 includes the first compressor 141 to compress the first refrigerant and discharge the same in a high temperature and high pressure state, the first condenser 142 to condense the compressed first refrigerant in the high temperature and high pressure state from the first compressor 141 via heat dissipation, the first expansion valve 143 to receive the condensed first refrigerant from the first condenser 142 through the first refrigerant pipe p1 and reduce the pressure of the condensed first refrigerant, and the first evaporator 144 to cool ambient air by absorbing ambient latent heat when the pressure-reduced first refrigerant from the first expansion valve 143 is supplied thereto.

The second refrigeration cycle system 150 includes the second compressor 151 to compress the second refrigerant and discharge the same in a high temperature and high pressure state, the second condenser 152 to condense the compressed second refrigerant in the high temperature and high pressure state from the second compressor 151 via heat dissipation, the second expansion valve 153 to receive the condensed second refrigerant from the second condenser 152 through the second refrigerant pipe p2 and reduce the pressure of the condensed second refrigerant, and the second evaporator 154 to cool ambient air by absorbing ambient latent heat when the pressure-reduced second refrigerant from the second expansion valve 153 is supplied thereto.

The first and second expansion valves 143 and 153 perform opening and closing operations in accordance with a drive signal of a control unit.

More specifically, the first expansion valve 143 opens to allow the refrigerant to be supplied to the first evaporator 144 when a freezing temperature of the freezing chamber 121 is above a first target temperature, and the first expansion valve 143 closes to prevent the refrigerant from being supplied to the first evaporator 144 when the freezing temperature of the freezing chamber 121 reaches the first target temperature. Similarly, the second expansion valve 153 opens to allow the refrigerant to be supplied to the second evaporator 154 when a refrigerating temperature of the refrigerating chamber 122 is above a second target temperature, whereas the second expansion valve 153 closes to prevent the refrigerant from being supplied to the second evaporator 154 when the refrigerating temperature of the refrigerating chamber 122 reaches the second target temperature.

That is, depending on the opening and closing operations of the first and second expansion valves 143 and 153, the refrigerants are supplied to the first and second evaporators 144 and 154, respectively. The first and second expansion valves 143 and 153 may have a capillary tube structure.

When the first refrigerant is supplied to the first evaporator 144 via the opening operation of the first expansion valve 143, the first evaporator 144 may cool ambient air and air in the freezing chamber 121 through a cooling effect, to allow the freezing chamber 121 to have a lower temperature. In a similar manner, when the second refrigerant is supplied to the second evaporator 154 via the opening operation of the second expansion valve 153, the second evaporator 154 may cool ambient air and air in the refrigerating chamber 122 through a cooling effect, to allow the refrigerating chamber 122 to have a lower temperature.

The first and second refrigeration cycle systems 140 and 150 circulate refrigerants having different refrigeration capacities per unit volume, respectively, in order to perform cooling operations.

By way of example, respective refrigerants contained in the first and second compressors 141 and 151 of the first and second refrigeration cycle systems 140 and 150 will be described with reference to FIG. 5.

As indicated in FIG. 5 illustrating comparison data of refrigerant properties among the refrigerants R600, R600a, and R134a, the refrigerant R600 has the smallest refrigeration capacity per unit volume while the refrigerant R134a has the largest refrigeration capacity per unit volume.

If the refrigerator employs the refrigerants R600 and R600a, the refrigerant R600 having a smaller refrigeration capacity per unit volume than the refrigerant R600a is contained in the second refrigeration cycle system to cool the refrigerating chamber with a relatively higher target temperature, whereas the refrigerant R600a is contained in the first refrigeration cycle system to cool the freezing chamber.

As shown in FIG. 5, the refrigeration capacity per unit volume of the refrigerant R600 is 35% smaller than that of the refrigerant R600a. Therefore, when the refrigerant R600 is used in a compressor for a refrigerating chamber of a refrigerator otherwise designed to employ the refrigerant R600a, the result is the same as a 35% reduction in a stroke volume of the compressor.

If the refrigerator employs the refrigerants R600 and R134a, the refrigerant R600 having a smaller refrigeration capacity per unit volume than the refrigerant R134a is contained in the second refrigeration cycle system to cool the refrigerating chamber with a relatively higher target temperature, whereas the refrigerant R134a is contained in the first refrigeration cycle system to cool the freezing chamber.

If the refrigerator employs the refrigerants R600a and R134a, the refrigerant R600a having a smaller refrigeration capacity per unit volume than the refrigerant R134a is contained in the second refrigeration cycle system to cool the refrigerating chamber with a relatively higher target temperature, whereas the refrigerant R134a is contained in the first refrigeration cycle system to cool the freezing chamber.

By this way of containing the refrigerant having the smaller refrigeration capacity per unit volume in the second refrigeration cycle system to cool the refrigerating chamber, the dual cycle loop may be conducted without deterioration of an efficiency of the compressor for the refrigerating chamber, because it is unnecessary to reduce the stroke volume of the compressor for the refrigerating chamber.

In addition, if both of the first and second storage chambers provided in the refrigerator have target temperatures within a refrigerating temperature range, both the target temperatures of the first and second storage chambers are above a predetermined temperature (i.e. a freezing temperature). Accordingly, the refrigerant having a smaller refrigeration capacity per unit volume than that of the refrigerant commonly contained in the refrigeration cycle system for the freezing chamber may be contained in the refrigeration cycle systems for the first and second storage chambers.

The first and second blowing fans 161 and 162 are installed to respectively face away from the first and second evaporators 143 and 153 of the first and second refrigeration cycle systems 140 and 150 so as to suck air in the freezing chamber 121 and air in the refrigerating chamber 122, respectively, while transferring air through the evaporator 143 and air through the evaporator 153 to the freezing and refrigerating chambers 121 and 122, respectively.

The refrigerator may further include a control device 180 to control operations of the first and second refrigeration cycle systems based on respective chamber temperatures in the freezing and refrigerating chambers detected using first and second temperature detection units 171 and 172. The refrigerator may further include a user interface 190 to set the first and second target temperatures and operate and check additional functions. This will be described with reference to FIG. 6.

Figure 6:
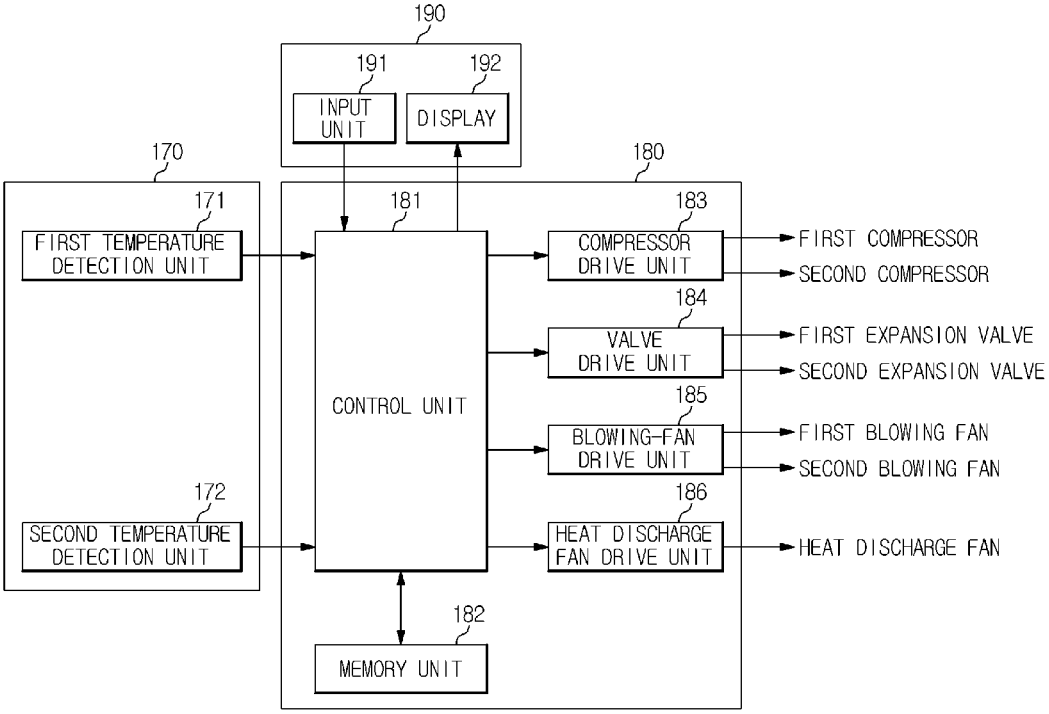
FIG. 6 is a block diagram illustrating control of a refrigerator according to one embodiment.

As shown in FIG. 6, the control device 180 includes a control unit 181, a memory unit 182, a compressor drive unit 183, a valve drive unit 184, a blowing fan drive unit 185, and a heat discharge fan drive unit 186. The user interface 190 includes an input unit 191 and a display 192.

When the first refrigeration cycle is not activated, the control unit 181 periodically receives a chamber temperature of the freezing chamber 121 from the first temperature detection unit 171 and compares the received chamber temperature with a first target temperature of the chamber 121 to control operation of the first refrigeration cycle system 140. On the other hand, when the first refrigeration cycle is activated, the control unit 181 compares the chamber temperature of the freezing chamber 121 with a first stop temperature thereof to control the first refrigeration cycle system 140 to be stopped or remain activated.

Accordingly, in performing the first refrigeration cycle, the first refrigerant circulates through the first refrigeration cycle system, thereby cooling the freezing chamber.

When the second refrigeration cycle is not activated, the control unit 181 periodically receives a chamber temperature of the refrigerating chamber 122 from the second temperature detection unit 172 and compares the received chamber temperature with a second target temperature of the chamber 122 to control operation of the second refrigeration cycle system 150. On the other hand, when the second refrigeration cycle is activated, the control unit 181 compares the chamber temperature of the refrigerating chamber 122 with a second stop temperature thereof to control the second refrigeration cycle system 150 to be stopped or remain activated.

Accordingly, in performing the second refrigeration cycle, the second refrigerant circulates through the second refrigeration cycle system, thereby cooling the refrigerating chamber.

When both of the chamber temperatures of the freezing and refrigerating chambers 121 and 122 exceed the first and second target temperatures respectively, the control unit 181 controls operations of both the first and second refrigeration cycle systems 140 and 150 to be activated.

Here, the second refrigerant to circulate through the second refrigeration cycle system to cool the refrigerating chamber has a smaller refrigeration capacity per unit volume than that of the first refrigerant to circulate through the first refrigeration cycle system to cool the freezing chamber. Thus, an evaporation temperature and evaporation pressure may become higher without reduction of the stroke volume of the second compressor.

The memory unit 182 stores the first and second target temperatures and the first and second stop temperatures.

The first and second target temperatures are initially set when manufacturing the refrigerator and the initially-set first and second target temperatures may be adjusted by the user and the adjusted temperatures may be stored as the first and second target temperatures. The first and second stop temperatures are determined based on the first and second target temperatures, respectively.

More specifically, the first and second stop temperatures may be set to be lower by a predetermined amount than the first and second target temperatures, respectively.

The compressor drive unit 183 operates at least one of the first and second compressors 141 and 142 in accordance with a command of the control unit 181.

The valve drive unit 184 enables opening and closing operations of at least one of the first and second expansion valves 143 and 153 in accordance with a command of the control unit 181.

The blowing fan drive unit 185 operates at least one of the first and second blowing fans 161 and 162 in accordance with a command of the control unit 181.

The heat discharge fan drive unit 186 operates the heat discharge fan 162 in accordance with a command of the control unit 181.

The input 191 of the user interface 190 may receive, from a user, the first and second target temperatures, respectively, and a particular function such as quick freezing, for example.

The display 192 of the user interface 190 may display the first and second target temperatures, the chamber temperatures of the freezing and refrigerating chambers, and a particular function selected by the user, for example.

Figure 7:
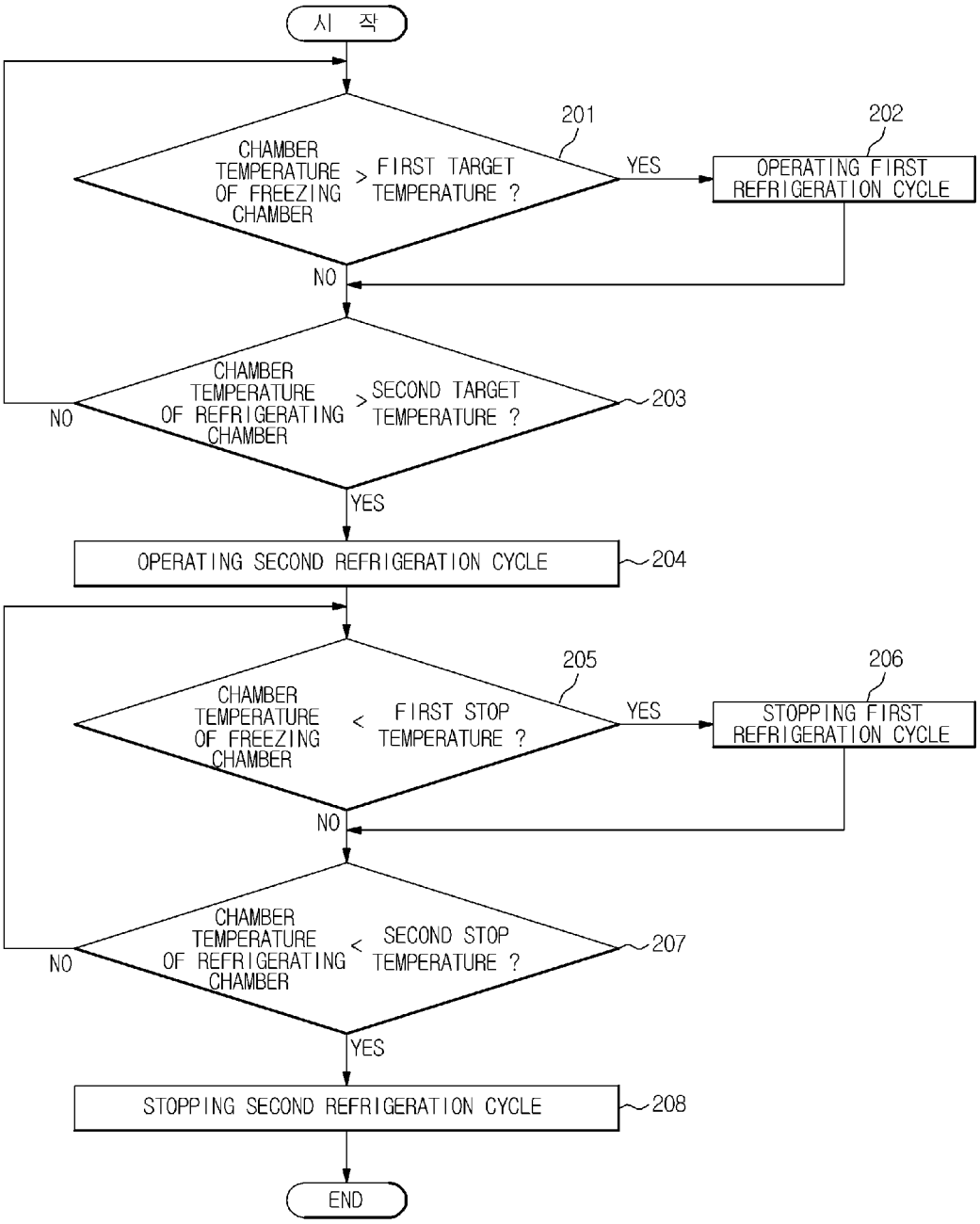
FIG. 7 is a flowchart illustrating control of a refrigerator according to one embodiment.

FIG. 7 is a flowchart illustrating control of a refrigerator according to one embodiment of the invention.

The first and second refrigeration cycle systems 140 and 150 of the refrigerator may be formed in a mechanically-separated state when the refrigerator is manufactured.

Next, different refrigerants r1 and r2 are respectively contained in the first and second refrigeration cycle systems 140 and 150 provided at the body of the refrigerator. Here, the refrigerants r1 and r2 respectively contained in the first and second refrigeration cycle systems 140 and 150 may have different refrigeration capacities per unit volume.

Upon containing refrigerants in the plural refrigeration cycle systems (the first and second refrigeration cycle systems 140 and 150 in the illustrated case), the manufacturer checks the target temperatures of the storage chambers to be respectively cooled by the plurality of refrigeration cycle systems, to arrange the plurality of refrigeration cycle systems in the order of the higher target temperatures of the storage chambers, and then disposes the refrigerants in the arranged plurality of refrigeration cycle systems in such a manner that the refrigerant, which has a smaller refrigeration capacity per unit volume than those of the remaining refrigerants, is contained in the refrigeration cycle system corresponding to the storage chamber, which has a higher target temperature than those of the remaining storage chambers.

For example, the plural storage chambers may include a freezing chamber having −18° C. as a first target temperature and a refrigerating chamber having −2° C. as a second target temperature. In this case, the manufacturer checks the first and second target temperatures of the freezing and refrigerating chambers and then disposes a refrigerant having a relatively smaller refrigeration capacity per unit volume in a refrigeration cycle system corresponding to the refrigerating chamber having a relatively higher target temperature.

That is, the second refrigerant r2 contained in the second refrigeration cycle system 150 to cool the refrigerating chamber has a smaller refrigeration capacity per unit volume than that of the first refrigerant r1 contained in the first refrigeration cycle system 140 to cool the freezing chamber.

In this manner, for the refrigerator where the refrigerants having different refrigeration capacities per unit volume are contained in the first and second refrigeration cycle systems 140 and 150, respectively, the first and second refrigeration cycles may be independently carried out. This will be described in further detail.

As shown in FIG. 7, the refrigerator periodically detects the chamber temperatures of the freezing and refrigerating chambers 121 and 122 using the first and second temperature detection units 171 and 172 respectively when the first and second refrigerating cycles are not activated.

Thereafter, the chamber temperature of the freezing chamber 121 is compared with the first target temperature thereof (201). When the chamber temperature of the freezing chamber 121 exceeds the first target temperature thereof, the first compressor 141 operates and the first expansion valve 143 opens, to circulate the first refrigerant through the first refrigeration cycle system 140. In this way, the first refrigeration cycle is performed (202).

Here, determining whether the chamber temperature of the freezing chamber 121 exceeds the first target temperature thereof may include determining whether the chamber temperature of the freezing chamber 121 exceeds the first target temperature thereof by a predetermined first amount.

The refrigerator determines whether to activate the second refrigeration cycle while performing the first refrigeration cycle.

In addition, the refrigerator may determine whether to activate the second refrigeration cycle although the chamber temperature of the freezing chamber 121 is below the first target temperature thereof.

To this end, the refrigerator determines whether the chamber temperature of the refrigerating chamber 122 exceeds the second target temperature thereof (203).

When the chamber temperature of the refrigerating chamber 121 exceeds the second target temperature thereof, the second compressor 151 operates and the second expansion valve 153 opens, to circulate the second refrigerant through the second refrigeration cycle system 150. In this way, the second refrigeration cycle is performed (204).

Here, determining whether the chamber temperature of the refrigerating chamber 122 exceeds the second target temperature may include determining whether the chamber temperature of the refrigerating chamber 122 exceeds the second target temperature by a predetermined second amount.

On the contrary, when the chamber temperature of the refrigerating chamber 122 is below the second target temperature, the refrigerator periodically determines whether to activate the first and/or second refrigeration cycles. If any of the determinations are affirmative, the process (201 to 204) of performing the first and/or second refrigeration cycles may be repeated.

In addition, the refrigerator may determine only whether to activate the second refrigeration cycle when the first refrigeration cycle is underway.

When the first refrigeration cycle is underway, the refrigerator compares the chamber temperature of the refrigerating chamber 122 with the second target temperature thereof to determine whether the chamber temperature of the refrigerating chamber 122 exceeds the second target temperature. Upon determining that the chamber temperature of the refrigerating chamber 122 exceeds the second target temperature, the refrigerator operates the second compressor 151 and opens the second expansion valve 153 while performing the first refrigeration cycle, to circulate the second refrigerant through the second refrigeration cycle system 150 and thus carry out the second refrigeration cycle.

In other words, when both of the chamber temperatures of the freezing and refrigerating chambers 121 and 122 exceed the first and second target temperatures, respectively, both of the first and second refrigeration cycle systems 140 and 150 carry out the first and second refrigeration cycles, respectively.

In addition, when the second refrigeration cycle is underway, the refrigerator compares the chamber temperature of the freezing chamber 121 with the first target temperature to determine whether the chamber temperature of the freezing chamber 121 exceeds the first target temperature. Upon determining that the chamber temperature of the freezing chamber 121 exceeds the first target temperature thereof, the first refrigeration cycle may be carried out.

Thereafter, when the first refrigeration cycle is ongoing, the refrigerator compares the chamber temperature of the freezing chamber 121 with the first stop temperature thereof to determine whether the chamber temperature of the freezing chamber 121 is below the first stop temperature (205). Upon determining that the chamber temperature of the freezing chamber 121 is below the first stop temperature, the refrigerator stops the first compressor 141 and closes the first expansion valve 143, to prevent circulation of the first refrigerant through the first refrigeration cycle system 140 and thus stop the first refrigeration cycle (206). Also, the refrigerator determines whether to stop the second refrigeration cycle.

In addition, the refrigerator may determine whether to stop the second refrigeration cycle although the chamber temperature of the freezing chamber 121 exceeds the first stop temperature.

To this end, the refrigerator compares the chamber temperature of the refrigerating chamber 122 with the second stop temperature thereof to determine whether to stop the second refrigeration cycle (207).

When the chamber temperature of the refrigerating chamber 122 is below the second stop temperature, the refrigerator stops the second compressor 151 and closes the second expansion valve 153, to prevent circulation of the second refrigerant through the second refrigeration cycle system 150 and thus stop the second refrigeration cycle (208).

On the contrary, when the chamber temperature of the refrigerating chamber 122 exceeds the second stop temperature, the refrigerator periodically determines whether to stop the first and/or second refrigeration cycles. If any of the determinations are affirmative, the process (205 to 208) of stopping the first and/or second refrigeration cycles may be repeated.

In addition, the refrigerator may determine only whether to stop the second refrigeration cycle when the first refrigeration cycle stops.

In other words, when both of the first and second refrigeration cycles are underway, the refrigerator periodically compares the chamber temperatures of the freezing and refrigerating chambers 121 and 122 with the first and second stop temperatures. Then, when the chamber temperature of the freezing chamber 121 is below the first stop temperature, the refrigerator stops the operation of the first refrigeration cycle system regardless of an operation state of the second refrigeration cycle system. Also, when the chamber temperature of the refrigerating chamber 122 is below the second stop temperature thereof, the refrigerator stops the operation of the second refrigeration cycle system regardless of an operation state of the first refrigeration cycle system. That is, one of the first and second refrigeration cycle systems may stop regardless of an operation state of the other refrigeration cycle system.

Only in case of overload conditions, such as a high outside temperature and frequent door opening, may both the first and second refrigeration cycles be simultaneously activated.

Figure 8:
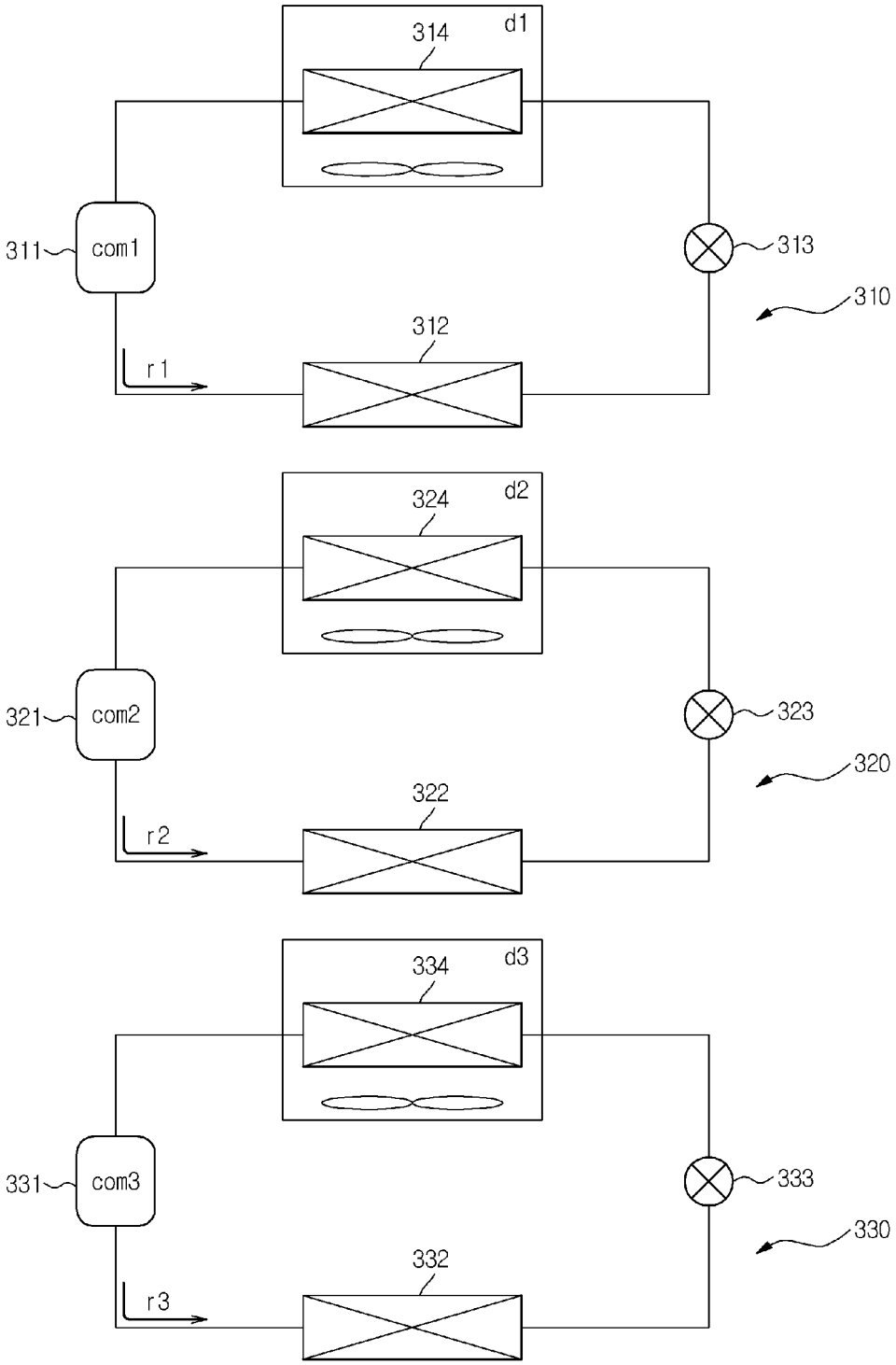
FIG. 8 illustrates a configuration of a plurality of refrigeration cycle systems provided in a refrigerator according to another embodiment.

FIG. 8 illustrates a configuration of a plurality of refrigeration cycle systems provided in a refrigerator according to another embodiment of the invention. In this embodiment, the refrigerator includes a freezing chamber, a refrigerating chamber, and a variable temperature chamber.

The variable temperature chamber is configured to have a chamber temperature varying between a temperature for warming, ripening, and/or fermenting objects stored therein and a refrigerating temperature for storing vegetables, for example. As for the variable temperature chamber, a refrigeration cycle is intermittently performed.

The refrigerator includes a first refrigeration cycle system 310 to cool the freezing chamber, a second refrigeration cycle system 320 to cool the refrigerating chamber, and a third refrigeration cycle system 330 to cool the variable temperature chamber.

The first refrigeration cycle system 310 includes a first compressor 311 to compress a first refrigerant r1 and discharge the same in a high temperature and high pressure state, a first condenser 312 to condense the compressed first refrigerant in the high temperature and high pressure state from the first compressor 311 via heat dissipation, a first expansion valve 313 to receive the condensed first refrigerant from the first condenser 312 through a first refrigerant pipe and reduce a pressure of the condensed first refrigerant, and a first evaporator 314 to cool ambient air by absorbing ambient latent heat when the pressure-reduced first refrigerant from the first expansion valve 313 is supplied thereto. The first refrigeration cycle system 310 further includes a first blowing fan to blow heat-exchanged cool air from the first evaporator 314 into the freezing chamber.

The second refrigeration cycle system 320 includes a second compressor 321 to compress a second refrigerant r2 and discharge the same in a high temperature and high pressure state, a second condenser 322 to condense the compressed second refrigerant in the high temperature and high pressure state from the second compressor 321 via heat dissipation, a second expansion valve 323 to receive the condensed second refrigerant from the second condenser 322 through a second refrigerant pipe and reduce a pressure of the condensed second refrigerant, and a second evaporator 324 to cool ambient air by absorbing ambient latent heat when the pressure-reduced second refrigerant from the second expansion valve 323 is supplied thereto. The second refrigeration cycle system 320 further includes a second blowing fan to blow heat-exchanged cool air from the second evaporator 324 into the refrigerating chamber.

The third refrigeration cycle system 330 includes a third compressor 331 to compress a third refrigerant r3 and discharge the same in a high temperature and high pressure state, a third condenser 332 to condense the compressed third refrigerant in the high temperature and high pressure state from the third compressor 331 via heat dissipation, a third expansion valve 333 to receive the condensed third refrigerant from the third condenser 332 through a third refrigerant pipe and reduce a pressure of the condensed third refrigerant, and a third evaporator 334 to cool ambient air by absorbing ambient latent heat when the pressure-reduced third refrigerant from the third expansion valve 333 is supplied thereto. The third refrigeration cycle system 330 further includes a third blowing fan to blow heat-exchanged cool air from the third evaporator 334 into the variable temperature chamber.

In the refrigerator, the first, second, and third refrigeration cycle systems 310, 320, and 330 are installed in a mechanically-separated manner, and are respectively supplied with different kinds of refrigerants.

In case when the relationship among first, second, and third target temperatures d1, d2, and d3 of the freezing, refrigerating, and variable temperature chambers becomes $d1<d2<d3$, refrigerants having different refrigeration capacities per unit volume are contained in the first, second, and third refrigeration cycle systems 310, 320, and 330, respectively, in such a manner that the refrigerant, which has a smaller refrigeration capacity per unit volume than those of the remaining refrigerants, is contained in the refrigeration cycle system corresponding to the storage chamber, which has a higher target temperature than those of the remaining storage chambers.

This will be specifically described with reference to FIG. 5 indicating the properties of the 3 refrigerants R600, R600a, and R134a. The refrigerant R600 is contained in the third refrigeration cycle system to cool the variable temperature chamber, the refrigerant R600a is contained in the second refrigeration cycle system to cool the refrigerating chamber, and the refrigerant R134a is contained in the first refrigeration cycle system to cool the freezing chamber.

In addition, in case when the chamber temperature of the variable temperature chamber varies within the target temperature range of the refrigerating chamber, the refrigerant contained in the third refrigeration cycle system may be the same kind as that contained in the second refrigeration cycle system.

By this manner of containing refrigerants having different refrigeration capacities per unit volume in respective compressors of the refrigerator depending on target temperatures of the corresponding storage chambers, desired stroke volumes of the compressors may be maintained, thereby preventing deterioration of efficiency of the compressors.

The above-described methods may be recorded in computer-readable media including program instructions to implement various operations embodied by a computer. The media may also include, alone or in combination with the program instructions, data files, data structures, and the like. The program instructions recorded on the media may be those specially designed and constructed for the purposes of embodiments, or they may be of the kind well-known and available to those having skill in the computer software arts. Examples of computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. The computer-readable media may also be a distributed network, so that the program instructions are stored and executed in a distributed fashion. The program instructions may be executed by one or more processors. The computer-readable media may also be embodied in at least one application specific integrated circuit (ASIC) or Field Programmable Gate Array (FPGA), which executes (processes like a processor) program instructions. Examples of program instructions include both machine code, such as produced by a compiler, and files containing higher level code that may be executed by the computer using an interpreter. The above-described devices may be configured to act as one or more software modules in order to perform the operations of the above-described embodiments, or vice versa.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a first storage chamber, in which a first chamber temperature of the first storage chamber is to be maintained at a target freezing temperature;

a second storage chamber, in which a second chamber temperature of the second storage chamber is to be maintained at a target non-freezing temperature higher than the target freezing temperature;

a first refrigeration cycle system which includes a first compressor having a first stroke volume to:

compress a first refrigerant having a first refrigeration capacity per unit volume for the target freezing temperature and the first stroke volume, and circulate the first refrigerant from the first compressor to cool the first storage chamber to be at the target freezing temperature;

a second refrigeration cycle system which includes a second compressor having a second stroke volume to:

compress a second refrigerant having a second refrigeration capacity per unit volume smaller than the first refrigeration capacity per unit volume of the first refrigerant, for the target non-freezing temperature and the second stroke volume, and circulate the second refrigerant from the second compressor to cool the second storage chamber to be at the target non-freezing temperature; and a control device configured to:

obtain the first and second chamber temperatures, operate the first refrigeration cycle system according to the first refrigeration capacity per unit volume of the first refrigerant or the second refrigeration cycle system according to the second refrigeration capacity per unit volume of the second refrigerant based on:

the first chamber temperature and the target freezing temperatures, and the second chamber temperature and the target non-freezing temperature, and in response to both of the first and second chamber temperatures exceeding the target freezing temperature and the target non-freezing temperature, respectively, control the first and second refrigeration cycle systems to operate simultaneously to control both the first and second refrigeration cycle systems according to the first refrigeration capacity per unit volume of the first refrigerant and the second refrigeration capacity per unit volume of the second refrigerant.

2. The refrigerator according to claim 1, wherein the first and second refrigeration cycle systems are installed to be separated from each other and circulate different refrigerants using different refrigeration cycles.

3. The refrigerator according to claim 1, further comprising:

a first temperature detection unit to detect the first chamber temperature; and a second temperature detection unit to detect the second temperature;

wherein the control device receives the detected first and second temperatures to obtain the first and second chamber temperatures and controls the operations of the first and second refrigeration cycle systems based on the detected first and second chamber temperatures and the corresponding target freezing temperature and the corresponding target non-freezing temperature.

4. The refrigerator according to claim 1, wherein the first and second storage chambers are freezing and refrigerating chambers, respectively.

5. The refrigerator according to claim 1, wherein:

the first refrigeration cycle system further comprises:

a first condenser to emit heat from the compressed first refrigerant from the first compressor;

a first expansion valve to reduce a pressure of the heat-emitted first refrigerant; and a first evaporator to absorb heat using the pressure-reduced first refrigerant and transfer the first refrigerant having absorbed heat to the first compressor, and the second refrigeration cycle system further comprises:

a second condenser to emit heat from the compressed second refrigerant from the second compressor;

a second expansion valve to reduce a pressure of the heat-emitted second refrigerant; and a second evaporator to absorb heat using the pressure-reduced second refrigerant and transfer the second refrigerant having absorbed heat to the second compressor.

6. The refrigerator according to claim 5, further comprising:

a first blowing fan to blow air having undergone heat exchange at the first evaporator to the first storage chamber; and a second blowing fan to blow air having undergone heat exchange at the second evaporator to the second storage chamber.

7. The refrigerator according to claim 5, further comprising at least one heat-discharge fan to cool the first and second condensers.

8. The refrigerator according to claim 7, further comprising:

a first temperature detection unit to detect the first chamber temperature; and a second temperature detection unit to detect the second chamber temperature;

wherein the control device controls operations of the first and second compressors, operations of the first and second expansion valves and an operation of the at least one heat-discharge fan, based on the detected first and second chamber temperatures and the corresponding target freezing temperature and the corresponding target non-freezing temperatures.

9. The refrigerator according to claim 1, wherein the first refrigerant includes a refrigerant R134*a*, and wherein the second refrigerant includes a refrigerant R600*a*.

10. The refrigerator according to claim 1, wherein the first refrigerant includes a refrigerant R600*a*, and wherein the second refrigerant includes a refrigerant R600.

11. The refrigerator according to claim 1, wherein the first refrigerant includes a refrigerant R134*a*, and wherein the second refrigerant includes a refrigerant R600.

12. The refrigerator according to claim 1, further comprising:

a third storage chamber, in which a third chamber temperature of the third storage chamber is to be maintained at a third target temperature;

a third refrigeration cycle system which includes a third compressor having a third stroke volume to:

compress a third refrigerant having a third refrigeration capacity per unit volume of the third refrigerant, for the third target temperature and the third stroke volume, and circulate the third refrigerant from the third compressor to cool the third storage chamber to be at the third target temperature, wherein:

the control device is further configured to:

obtain the third chamber temperature, operate the first refrigeration cycle system according to the first refrigeration capacity per unit volume of the first refrigerant, the second refrigeration cycle system according to the second refrigeration capacity per unit volume of the second refrigerant or the third refrigeration cycle system according to the third refrigeration capacity per unit volume of the third refrigerant based on:

the first chamber temperature and the target freezing temperatures, the second chamber temperature and the target non-freezing temperature, and the third chamber temperature and the third target temperature, and in response to at least two of the first, second, and third chamber temperatures exceeding at least two of the target freezing temperature, the target non-freezing temperature and the third target temperatures respectively, control at least two of the first, second and third refrigeration cycle systems to operate simultaneously to control the first, second and third refrigeration cycle systems according to the first refrigeration capacity per unit volume of the first refrigerant, the second refrigeration capacity per unit volume of the second refrigerant and the third refrigeration capacity per unit volume of the third refrigerant, wherein the first, second, and third refrigerants have different refrigeration capacities per unit volume.

13. A refrigerator comprising:

a plurality of storage chambers, in which respective chamber temperatures in the plurality of storage chamber are to be maintained at respectively corresponding target temperatures, wherein at least one target temperature of the corresponding target temperatures is a target freezing temperature;

a plurality of refrigeration cycle systems configured to contain different types of refrigerants respectively having different refrigeration capacities per unit volume for the corresponding target temperatures, respectively, and provided in a corresponding manner to the plurality of the storage chambers so as to cool the corresponding storage chambers to be at the corresponding target temperatures; and a control device to control the plurality of refrigeration cycle systems, the control device configured to:

obtain the respective chamber temperatures in the plurality of storage chambers to be cooled by the plurality of refrigeration cycle system respectively, operate at least one of the plurality of the refrigeration cycle systems according to the different refrigeration capacities per unit volume of the different types of refrigerants based on the obtained respective chamber temperatures in the plurality of storage chambers and the respectively corresponding target temperatures, and in response to at least two respective chamber temperatures of at least two chambers to be cooled by at least two of the plurality of refrigeration cycle systems exceeding at least two respectively corresponding target temperatures of the at least two chambers respectively, control at least two of the plurality of refrigeration cycle systems to operate simultaneously to control the at least two refrigeration cycle systems according to the different refrigeration capacities per unit volume of the different types of refrigerants.

14. The refrigerator according to claim 13, wherein the plurality of refrigeration cycle systems are installed to be separated from one another and individually carry out refrigeration cycles thereof.

15. A method to control a refrigerator having first and second storage chambers separated from each other, comprising:

by a control device:

obtaining a first chamber temperature of the first storage chamber;

controlling circulation of a first refrigerant in a first refrigeration cycle system according to a first refrigeration capacity per unit volume of the first refrigerant for the target freezing temperature based on the obtained first chamber temperature and a target freezing temperature of the first storage chamber so that the first storage temperature is to be kept at the target freezing temperature;

obtaining a second chamber temperature of the second storage chamber; and controlling circulation of a second refrigerant in a second refrigeration cycle system according to a second refrigeration capacity per unit volume of the second refrigerant smaller than the first refrigeration capacity per unit volume of the first refrigerant for a target non-freezing temperature based on the obtained second chamber temperature and the target non-freezing temperature of the second storage chamber so that the second chamber temperature is to be kept at the target non-freezing temperature;

operating the first refrigeration cycle system according to the first refrigeration capacity per unit volume of the first refrigerant or the second refrigeration cycle system according to the second refrigeration capacity per unit volume of the second refrigerant based on:

the obtained first chamber temperature and the target freezing temperatures, and the obtained second chamber temperature and the target non-freezing temperatures; and in response to both of the first and second chamber temperatures exceeding the target freezing temperature and the target non-freezing temperature, respectively, controlling the first and second refrigeration cycle systems to operate simultaneously to control the first and second refrigeration cycle systems according to the first refrigeration capacity per unit volume of the first refrigerant and the second refrigeration capacity per unit volume of the second refrigerant.

16. The method according to claim 15, wherein the controlling of the circulation of the first refrigerant and the controlling of the circulation of the second refrigerant are independently performed.

17. The method according to claim 15, wherein the controlling of the circulation of the first refrigerant in the first refrigeration cycle system comprises controlling an operation of a first compressor provided in the first refrigeration cycle system; and the controlling of the circulation of the second refrigerant in the second refrigeration cycle system comprises controlling an operation of a second compressor provided in the second refrigeration cycle system.

18. A non-transitory computer-readable recording medium storing a program to implement the method of claim 15.

* * * * *